US006137230A

United States Patent [19]

Born et al.

[11] Patent Number: 6,137,230

[45] Date of Patent: Oct. 24, 2000

[54] METAL HALIDE LAMP

[75] Inventors: Matthias Born, Krefeld; Rüdiger Jost, Aachen, both of Germany; Franciscus C. B. M. Van Vroonhoven, Eindhoven, Netherlands

[73] Assignee: U.S. Philips Corporation, New York, N.Y.

[21] Appl. No.: 09/112,886

[22] Filed: Jul. 9, 1998

[30] Foreign Application Priority Data

Jul. 23, 1997 [EP] European Pat. Off. ..... 97202301

[51] Int. Cl.[7] ..... H01J 61/30

[52] U.S. Cl. ..... 313/638; 313/620; 313/634; 313/643

[58] Field of Search ..... 613/638, 620, 613/634, 643, 570

[56] References Cited

U.S. PATENT DOCUMENTS 5,424,609 6/1995 Geven et al. ..... 313/623
5,627,430 5/1997 Kira et al. ..... 313/570
5,973,453 10/1999 Van Vliet et al. ..... 313/634 X
5,986,402 11/1999 Narita et al. ..... 313/620

FOREIGN PATENT DOCUMENTS 0215524 3/1987 European Pat. Off. ..... H01J 61/30
1280370 7/1972 United Kingdom ..... H01J 61/22

*Primary Examiner*—Ashok Patel
*Attorney, Agent, or Firm*—F. Brice Faller

[57] ABSTRACT

A discharge vessel with a ceramic wall encloses a discharge space in which besides a rare gas also an ionizable filling comprising at least NaI is present. Two electrodes having tips with a mutual distance EA are arranged in the discharge space which discharge vessel has an internal diameter Di over at least the electrode distance EA. The discharge space is Hg-free and the ionizable filling further comprises Zn and the electrode distance EA and the internal diameter Di comply with the relation $1 \leqq EA/Di \leqq 4$.

9 Claims, 1 Drawing Sheet

METAL HALIDE LAMP

BACKGROUND OF THE INVENTION

The invention relates to a metal halide lamp provided with a discharge vessel with a ceramic wall which encloses a discharge space in which besides a rare gas also an ionizable filling comprising at least NaI is present, two electrodes having tips with a mutual distance EA being arranged in said discharge space which discharge vessel has an internal diameter Di over at least the electrode distance EA.

A lamp of the kind mentioned in the opening paragraph is known from EP-A-0 215 524. The known lamp, in which a high luminous efficacy goes hand in hand with excellent color properties (inter alia a general color rendering index $R_a \geqq 70$ and a color temperature $T_c$ of between 2600 and 4000 K), is highly suitable as a light source for inter alia interior lighting. This lamp construction is based on the recognition that a good color rendering is possible when sodium halide is used as a filling ingredient of a lamp and a strong widening and inversion of the Na emission in the Na-D lines takes place during lamp operation. This requires a high coldest-spot temperature $T_{kp}$ in the discharge vessel of, for example, 1170 K (900° C.). Inversion and widening of the Na-D lines imply that they take the shape of an emission band in the spectrum with two maxima at a mutual distance of $\Delta\lambda$. The requirement that $T_{kp}$ should have a high value excludes the use of quartz or quartz glass for the discharge vessel wall and renders the use of a ceramic material for the discharge vessel wall necessary.

The term "ceramic wall" in the present description and claims is understood to cover a wall of metal oxide such as, for example, sapphire or densely sintered polycrystalline $Al_2O_3$ as well as metal nitride, for example AlN.

The known lamp combines a good color rendering with a comparatively wide range of the color temperature. The filling of the discharge vessel comprises at least Hg, Na halide and Tl halide. In addition, the discharge vessel preferably contains at least one element from the group formed by Sc, La, and the lanthanides Dy, Tm, Ho, and Er.

The known lamp has a lamp voltage during stable operation of between 70 and 110V, being the general accepted range for discharge lamps. In the known lamp this voltage is mainly sustained during stable operation by the mercury which forms part of the filling. However Hg forms a heavy burden on the environment in case it would be released, for instance at the end of the life of the lamp.

SUMMARY OF THE INVENTION

The invention has for its object to provide a metal halide lamp with a mercury free filling which is electrical retrofit with the known lamp.

According to the invention, the discharge space is Hg-free and the ionizable filling further comprises Zn and the electrode distance EA and the internal diameter Di comply with the relation $1 \leqq EA/Di \leqq 4$.

Surprisingly it is possible to achieve comparable luminous efficacy and colour properties (inter alia a general color rendering index $R_a \geqq 70$ and a color temperature $T_c$ of between 2600 and 4000 K) as in case of the known lamp and have the advantage of being Hg-free. Values of EA/Di>4 lead to extreme high values of the lamp voltage during stable operation resulting in non-retrofit lamps. Otherwise values of EA/Di<1 are not used because at such values the coldest spot temperature $T_{kp}$ easily assumes a too low value which will result in unacceptable colour properties of the light emitted by the lamp. Preferably the Zn is contained in metallic form in a quantity of at least 100 $\mu$mol/cm$^3$, as to have also in the discharge vessel construction of the known lamp a sufficient amount inside the actual discharge space.

According to a further embodiment the Zn is at least partly contained as compound $ZnI_2$ in a quantity of at most 20 $\mu$mol/cm$^3$. The use of $ZnI_2$ improves the luminous efficacy of the lamp without altering its colour properties. The amount should be restricted to the mentioned value as to prevent too large a curvature of the discharge arc between the electrodes. Besides $ZnI_2$ has the advantage that it can be regarded to be chemically inert with respect to the fillings of the known lamp. If the Zn is contained exclusively in the form of the compound $ZnI_2$, the quantity should at least be 4 $\mu$mol/cm$^3$. It has appeared that because the compound $ZnI_2$ will be fully evaporated during lamp operation the quantity can suffice to arrive at a lamp voltage suitable for the lamp being retrofit.

Preferable the rare gas is Xe with a fill pressure of at least 400 mbar. Because of its relative heavy weight Xe has excellent properties as a buffer gas and thus a favourable influence on the luminous efficacy of the lamp. Ar as the rare gas is however also suitable.

Preferably the ionizable filling comprises constituents with quantities satisfying ranges in $\mu$mol/cm$^3$ as indicated:

metallic Zn 0–2000
$ZnI_2$ 0–20
NaI 20–200
TlI 0–30
RE-iodide 0–40, with RE being at least one of the elements formed by the group of In, Sc, Y and the lanthanides, and in case the Zn is exclusively contained as the compound $ZnI_2$, the quantity of $ZnI_2$ is at least 4 $\mu$mol/cm$^3$. Thus the lamp will be electrical retrofit with respect to the known lamp and also have comparable colour properties.

In an advantageous embodiment the lamp has a power density measured over the electrode distance EA of at least 3 W/cm and at most 130 W/cm. By fulfilling this requirement the invented lamp has a constructive length which is comparable with the known lamp. This has the advantage that the lamp can readily be used in existing fixtures.

DETAILED DESCRIPTION OF THE PREFERRED EMBODIMENTS

Figure 1:
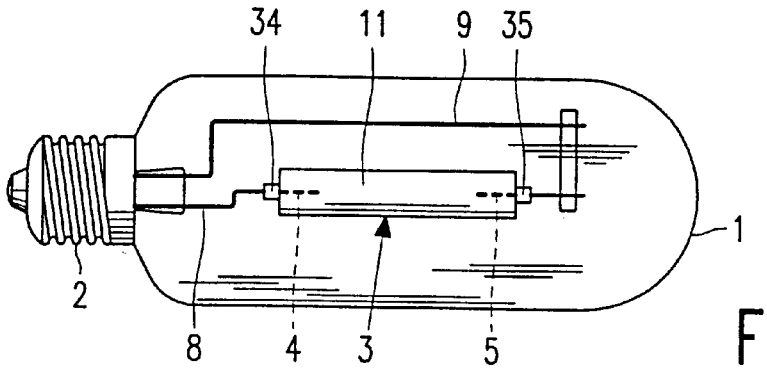
FIG. 1 diagrammatically shows a lamp according to the invention.
Figure 2:
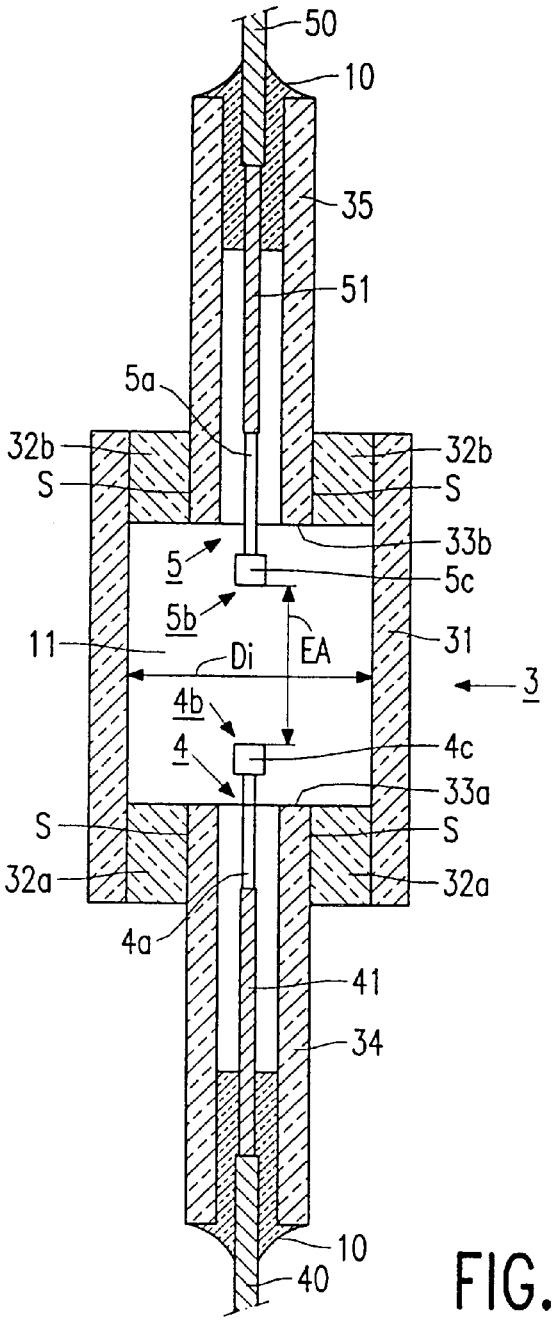
FIG. 2 shows the discharge vessel of the lamp of FIG. 1 in detail. (not to scale)

FIG. 1 shows a metal halide lamp provided with a discharge vessel 3 having a ceramic wall which encloses a discharge space 11 containing an ionizable filling. Two electrodes whose tips are at a mutual distance EA are arranged in the discharge space, and the discharge vessel has an internal diameter Di at least over the distance EA. The discharge vessel is closed at one side by means of a ceramic projecting plug 34, 35 which encloses a current lead-through conductor (FIG. 2: 40, 41, 50, 51) to an electrode 4, 5 positioned in the discharge vessel with a narrow intervening space and is connected to this conductor in a gastight manner by means of a melting-ceramic joint (FIG. 2: 10) at an end remote from the discharge space. The discharge vessel is surrounded by an outer bulb 1 which is provided with a lamp cap 2 at one end. A discharge will extend between the electrodes 4, 5 when the lamp is operating. The electrode 4 is connected to a first electrical contact forming part of the lamp cap 2 via a current conductor 8. The electrode 5 is connected to a second electrical contact forming part of the lamp cap 2 via a current conductor 9. The discharge vessel, shown in more detail in FIG. 2 (not true to scale), has a ceramic wall and is formed from a cylindrical part with an internal diameter Di which is bounded at either end by a respective end wall portion 32*a,* 32*b,* each end wall portion 32*a,* 32*b* forming an end surface 33*a,* 33*b* of the discharge space. The end wall portions each have an opening in which a ceramic projecting plug 34, 35 is fastened in a gastight manner in the end wall portion 32*a,* 32*b* by means of a sintered joint S. The ceramic projecting plugs 34, 35 each narrowly enclose a current lead-through conductor 40, 41, 50, 51 of a relevant electrode 4, 5 having a tip 4*b,* 5*b*. The current lead-through conductor is connected to the ceramic projecting plug 34, 35 in a gastight manner by means of a melting-ceramic joint 10 at the side remote from the discharge space.

The electrode tips 4*b,* 5*b* are arranged at a mutual distance EA. The current lead-through conductors each comprise a halide-resistant portion 41, 51, for example in the form of a Mo—$Al_2O_3$ cermet and a portion 40, 50 which is fastened to a respective end plug 34, 35 in a gastight manner by means is of the melting-ceramic joint 10. The melting-ceramic joint extends over some distance for example approximately 1 mm, over the Mo cermet 40, 41. It is possible for the parts 41, 51 to be formed in an alternative manner instead of from a Mo—$Al_2O_3$ cermet. Other possible constructions are known, for example, from EP-0 587 238 (U.S. Pat. No. 5,424,609). A particularly suitable construction was found to be a halide-resistant coil applied around a pin of the same material. Mo is very suitable for use as material which is to a high degree halide-resistant. The parts 40, 50 are made from a metal whose coefficient of expansion corresponds very well to that of the end plugs. Nb, for example, is a highly suitable material therefor. The parts 40, 50 are connected to the current conductors 8, 9 in a manner not shown in any detail. The lead-through construction described renders it possible to operate the lamp in any burning position as desired.

Each of the electrodes 4, 5 comprises an electrode rod 4*a,* 5*a* which is provided with a coiling 4*c,* 5*c* near the tip 4*b,* 5*b*. The projecting ceramic plugs are fastened in the end wall portions 32*a* and 32*b* in a gastight manner by means of a sintered joint S. The electrode tips then lie between the end surfaces 33*a,* 33*b* formed by the end wall portions. In an alternative embodiment of a lamp according to the invention, the projecting ceramic plugs 34, 35 are recessed behind the end wall portions 32*a,* 32*b*. In that case the electrode tips lie substantially in the end surfaces 33*a,* 33*b* defined by the end wall portions.

In a practical realization of a lamp according to the invention as shown in the drawing, the rated lamp power is 75 W and an arc voltage of 86V. The lamp was operated on an electronic supply, type EMC 070 W, make Philips. The mutual distance EA between the electrodes is 9 mm and the internal diameter Di over this distance is 4.5 mm, resulting in a value for the relation EA/Di of 2. The lamp has a luminous efficacy of 84 lm/W. The generated light has a general color rendering index $R_a$ of 84 and a color temperature $T_c$ of 2880 K corresponding to colour point coordinates (x,y) (0.436;0.387). The discharge vessel of the lamp had a filling consisting of 12 mg Zn, 5.0 mg NaI, 1.0 mg TlI, 2.0 mg $DyI_3$ and Xe with a fill pressure at room temperature of 400 mbar. The total volume of the discharge vessel is 0.175 $cm^3$. The filling quantities therefor correspond to 1050 $\mu mol/cm^3$, 190 $\mu mol/cm^3$, 17 $\mu mol/cm^3$ and 21 $\mu mol/cm^3$.

In a further practical embodiment with the same geometry, the discharge vessel filling contained besides NaI, TlI and $DyI_3$ only 10 mg Zn, corresponding to 874 $\mu mol/cm^3$, and a Xe fill pressure at room temperature of 2 bar. The initial values for lamp power, luminous efficacy, general colour index $R_a$ and colour temperature $T_c$ are; 74 W, 88 lm/W, 78 and 2980 K. As the lamp has an arc voltage of 94V it is electrical retrofit with the known lamp.

From a further practical embodiment the filling of the discharge lamp contains besides metallic Zn also $ZnI_2$ with a filling quantity of 0.9 mg, resulting in an operating pressure of 2.5 bar and corresponding to 13 $\mu mol/cm^3$. With the electrode distance being unchanged and the internal diameter Di slightly increased to 5.1 mm the value of EA/Di is reduced to 1.7. The lamp voltage is reduced to 85V. The color temperature $T_c$ is increased to 3090 K corresponding to colour point coordinates (x,y) (0.429;0.398). The values for the luminous efficacy and the general colour index $R_a$ have only slightly decreased to 86 lm/W and 76.

In yet another embodiment the electrode distance is 10.8 mm and the internal diameter Di 5.1 mm, thus EA/Di=2.1. The filling of the discharge vessel consists of Ar with fill pressure of 400 mbar, 8 mg of a mixture of NaI, TlI and $DyI_3$, in a weight ratio of 5:1:2 and 7 mg Zn. The lamp has a power of 75 W. The lamp which has an initial lamp voltage of 85V, is emitting light with a luminous efficacy of 79 lm/W at a color temperature $T_c$ of 2750 K and with a value of general colour index $R_a$ of 79. After 100 hours of lamp operation the lamp voltage has increased to 95V. The luminous efficacy has slightly decreased to 77 lm/W whilst the colour temperature $T_c$ and the general colour index $R_a$ have not significantly changed, having the values 2780 K and 79.

A practical embodiment of a lamp according to the invention in which the filling includes Zn exclusively in the form of $ZnI_2$ is described hereunder. The ceramic discharge vessel has an internal diameter Di of 3.52 mm over a distance between the electrodes EA of 12.88 mm. The total volume of the discharge vessel is 0.145 $cm^3$. The filling of the discharge vessel contains 0.21 mg $ZnI_2$, 5 mg NaI, 1 mg $DyI_3$, 2 mg $DyJ_3$ and 400 mbar Xe at room temperature. The amount of $ZnI_2$ corresponds to 4,5 $\mu mol/cm^3$. The lamp has a nominal power of 75 W with a lamp voltage of 71V. The luminous efficacy of the lamp is 75 lm/W with a value of 3000 K for the colour temperature $T_c$ and of 80 for the general colour index $R_a$.

What is claimed is:

1. Metal halide lamp provided with a discharge vessel with a ceramic wall which encloses a discharge space in which besides a rare gas also an ionizable filling comprising at least NaI is present, two electrodes having tips with a mutual distance EA being arranged in said discharge space which discharge vessel has an internal diameter Di over at least the electrode distance EA, characterized in that the discharge space is Hg-free and the ionizable filling further comprises Zn and in that the electrode distance EA and the internal diameter Di comply with the relation $1 \leqq EA/Di \leqq 4$.

2. Lamp according to claim 1, wherein the Zn is in metallic form in a quantity of at least 100 $\mu mol/cm^3$.

3. Lamp according to claim 1 wherein the Zn is at least partly contained as $ZnI_2$ in a quantity of at most 20 $\mu mol/cm^3$.

4. Lamp according to claim 1 wherein the Zn is contained exclusively in the form of $ZnI_2$ and the quantity is at least 4 $\mu mol/cm^3$.

5. Lamp according to claim 1, wherein the rare gas is Xe with a fill pressure of at least 400 mbar.

6. Lamp according to claim 1, wherein the ionizable filling comprises constituents with quantities satisfying ranges in $\mu mol/cm^3$ as indicated:

metallic Zn 0–2000
$ZnI_2$ 0–20
NaI 20–200
TlJ 0–30
RE-jodide 0–40, with RE being at least one of the elements formed by the group of In, Sc, Y and the lanthanides.

7. Lamp according to claim 1 wherein the lamp has a power density measured over the electrode distance EA of at least 3 W/cm and at most 130 W/cm.

8. Lamp according to claim 6 wherein Zn is contained in the ionizable filling exclusively in the compound $ZnI_2$ in an amount of at least 4 $\mu$mol/cm$^3$.

9. Metal halide lamp comprising a discharge vessel comprising a ceramic wall enclosing a discharge space, said discharge vessel having an internal diameter Di over at least an electrode distance EA, two electrode tips arranged in said discharge space, said electrode tips being separated by a distance EA, wherein $1 \leqq EA/Di \leqq 4$, and an inert gas and an ionizable filling in said discharge space, said ionizable filling comprising NaI and Zn, said discharge space being Hg-free.

* * * * *